United States Patent [19]

Muller-Girard et al.

[11] 3,936,814

[45] Feb. 3, 1976

[54] SMOKE DETECTOR AND ALARM

[75] Inventors: Otto Muller-Girard, Rochester; Chester W. Bray, Hilton, both of N.Y.

[73] Assignee: Bernz-O-Matic, Rochester, N.Y.

[22] Filed: Apr. 29, 1974

[21] Appl. No.: 465,442

[52] U.S. Cl. ..... 340/237 S; 250/574; 356/207

[51] Int. Cl.[2] ..... G08B 17/10

[58] Field of Search ..... 340/237 S; 250/239, 552, 250/554, 564, 565, 574; 356/206, 207

[56] References Cited

UNITED STATES PATENTS

| | | | |
|---|---|---|---|
| 3,504,184 | 3/1970 | Eaton et al. | 250/574 |
| 3,723,747 | 3/1973 | Steele | 340/237 S X |
| 3,774,186 | 11/1973 | Enemark | 340/237 S |

*Primary Examiner*—Donald J. Yusko
*Assistant Examiner*—Daniel Myer
*Attorney, Agent, or Firm*—Burgess, Dinklage & Sprung

[57] ABSTRACT

A smoke detector and alarm utilizing two photo resistors, one of which is used to detect smoke in an enclosed chamber and the other of which is used to compensate for line voltage variations and the effect of such variations on the smoke detecting photo resistor, and to supervise or monitor the light source so as to detect and signal light source failure in a distinct way.

7 Claims, 6 Drawing Figures a.
b.
LDR-2
LDR-1
32'
32
28
29
29'

10
12
14
16
21
22
23
24
26
27
28
29
29'
30
30'
LDR-2
LDR-1
AC POWER SOURCE
SMOKE IN
SMOKE OUT

SMOKE DETECTOR AND ALARM

BACKGROUND

This invention relates to a smoke detector and alarm which is capable of detecting white and gray smoke as well as black smoke and which is self-monitoring and entirely reliable regardless of fluctuations in line voltage.

A fire in a residential or a commercial building generates heat and smoke. Heat detector alarms have been used with a certain degree of success, but often times a fire is well established before sufficient heat is given off to trigger such a device. Because smoke build-up is much more rapid than heat, especially in confined areas having insufficient oxygen to support combustion, attempt have been made to provide an earlier alarm by detecting the first presence of smoke and quickly sounding an alarm. Devices proposed for this purpose are usually designed to detect small particles suspended in air, i.e., smoke, which generally rise from the source of the fire. Typical smoke detector devices are described in U.S. Pat. No. 2,537,028 issued Jan. 9, 1951 to Lahusac et al., U.S. Pat. No. 3,382,762 issued May 14, 1968 to Vasel et al., U.S. Pat. No. 3,383,670 issued May 14, 1969 to Roberts and U.S. Pat. No. 3,497,303 issued Feb. 24, 1970 to Enemark et al.

However, prior art smoke detector devices are complex and costly in structure, often requiring expensive lenses and other special parts such as a porous housing. Moveover, prior devices have proven to be not entirely reliable or capable of meeting UL (Underwriters' Laboratory, Inc.) standard for smoke detectors. These standards require flawless operation at elevated temperatures, self-monitoring capabilities and, most importantly, reliability at all times, regardless of line voltage variations which can, undesirably, cause premature triggering of the alarm directly or indirectly by creating a temporary imbalance in the otherwise sensitive smoke sensing systems. Prior art smoke detectors have failed to fully meet all of these requirements and at the same time provide an economic smoke detector unit for wide and diverse use.

The present invention provides such a smoke detector and alarm which is capable of detecting white and gray smoke as well as black smoke and which is self-monitoring and entirely reliable regardless of line voltage variations.

SUMMARY

The present invention provides a smoke detector and alarm which, in its broadest sense, utilizes two photoresistors one of which is used to detect smoke in an enclosed chamber and the other of which is used to compensate for line voltage variations and the effect of such variations on the smoke detecting photoresistor and to supervise or monitor the light source so as to detect and signal light source failure in a distinct way.

More particularly, the smoke detector and alarm of the present invention comprises:

a. smoke chamber means;

b. circuit means connecting a light source, a first light sensitive resistor, a second light sensitive resistor and electronic alarm means;

c. the smoke chamber means having:

i. a first light passage permitting light from the light source to illuminate the interior of said chamber;

ii. a second light passage positioned relative to said first passage so as to permit light from said first passage to fall on said second light sensitive resistor; and iii. a third light passage positioned relative to said first passage so as to permit only light reflected by smoke present in said chamber to fall on said first light sensitive resistor;

d. said circuit means having:

i. alarm circuit means causing said alarm means to emit a continuous sound when light from said source is reflected by smoke present in said chamber onto said first light sensitive resistor; and ii. trouble circuit means causing said alarm means to emit an intermittent sound when light fails to fall on said second light sensitive resistor.

In a preferred embodiment the smoke detector circuit means includes means to prevent line voltage variations from inducing false triggering of the alarm means and, further, means to maintain the ratio of the resistance between the two light sensitive resistors constant, so as to be unaffected by changes in brightness of the light source caused by variations in line voltage and/or aging, or other obstructions of the light source such as by dust or filming.

DESCRIPTION OF THE DRAWING

The present invention will be more fully understood from the following description taken in conjunction with the accompanying drawing wherein.

DESCRIPTION

Figure 1:
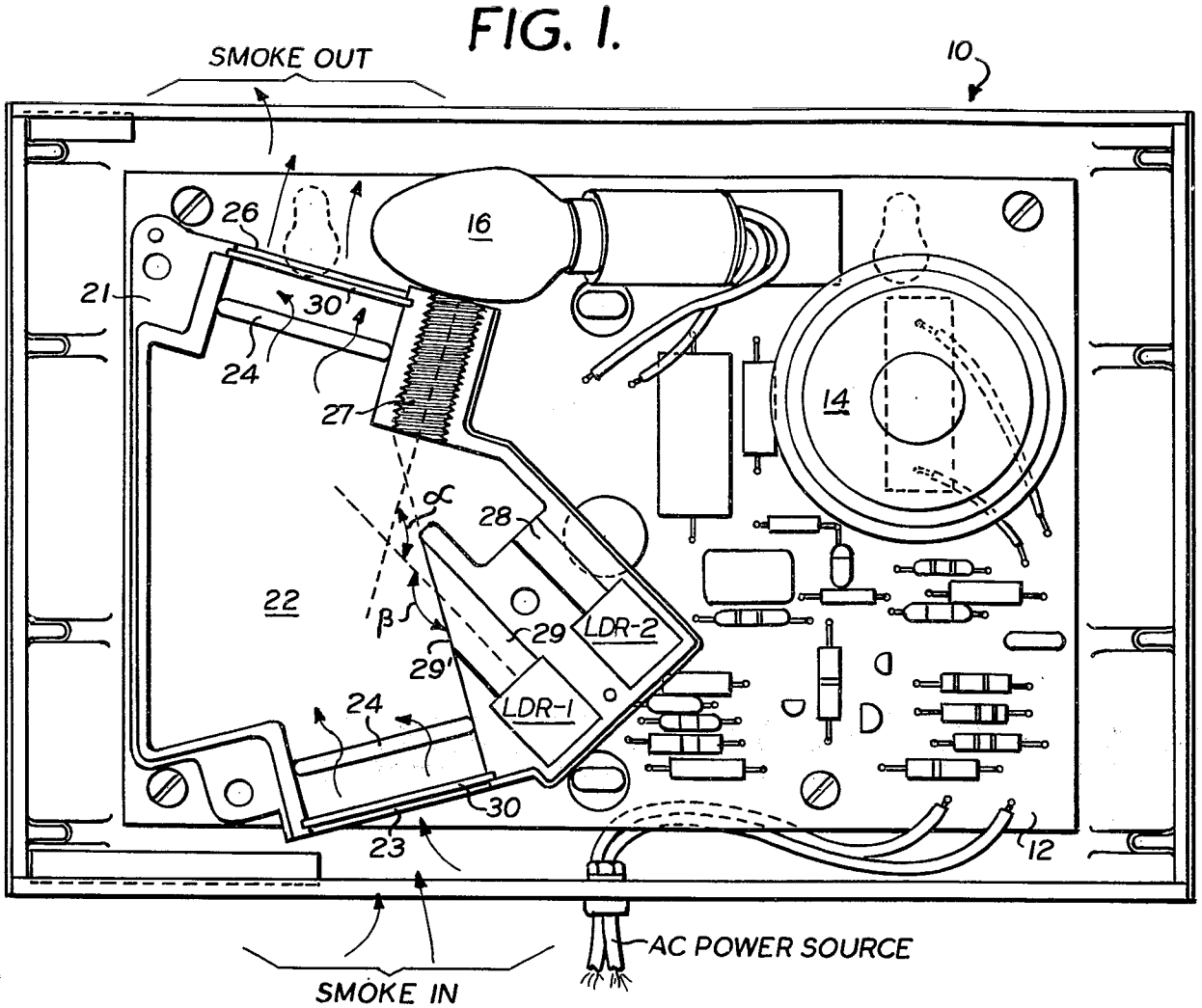
FIG. 1 is a top plan view of a preferred smoke detector and alarm according to the invention with the upper half of the smoke detection chamber removed to illustrate details of the interior thereof.
Figure 2:
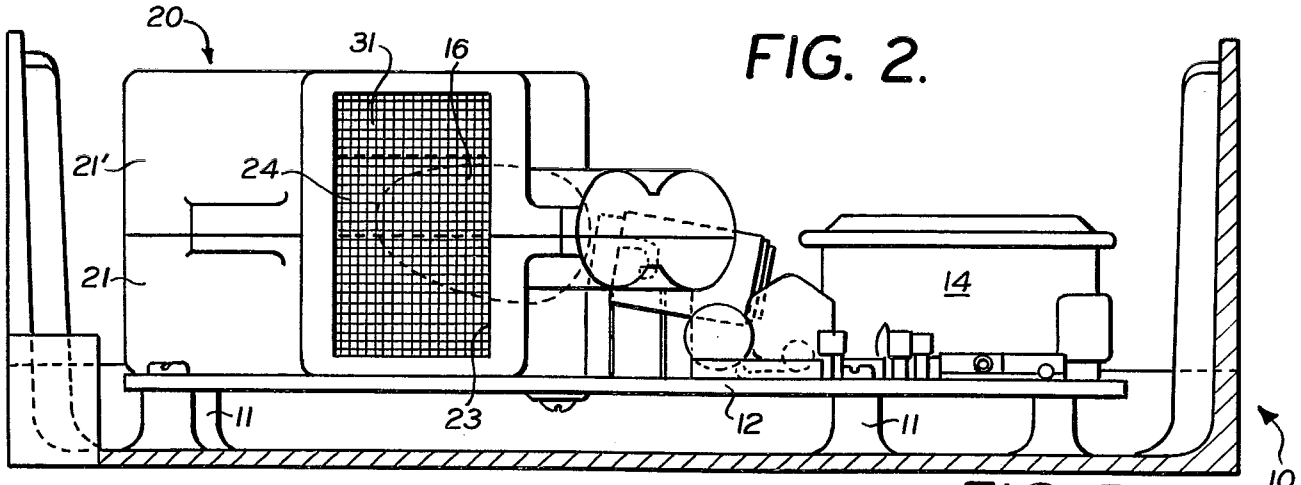
FIG. 2 is a side view in elevation partly broken away of the smoke detector and alarm of FIG. 1 with the upper half of the smoke detection chamber in place.

Referring now to the drawing and in particular to FIGS. 1 and 2 thereof, the smoke detector and alarm of the invention can be considered to be made of two sub-assemblies. The first sub-assembly which supports and protects the internal parts of the smoke detector is basically a housing made up of a base 10 which can be cast or formed from metals and plastics andd a cover (not shown) which can also be cast or formed from metals and plastics. The other sub-assembly is the circuit sub-assembly which contains all of the functional parts of the smoke detector and alarm. The circuit sub-assembly includes an etched circuit board 12 (mounted to base 10 via raised bosses 11) on which are mounted the electronic components including the horn alarm 14, the smoke detection chamber 20 and lamp 16.

Figure 3:
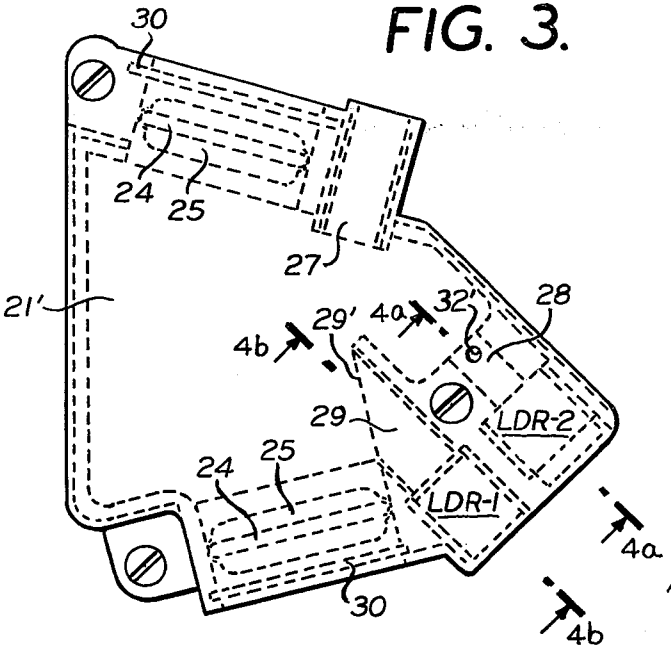
FIG. 3 is a top plan view of the smoke detection chamber utilized in the present invention with interior configurations shown in dotted lines.

The smoke detection chamber 20 is generally cast from a plastic, preferably a thermo-setting material, in two parts, a lower half 21 and an upper half 21' (FIG. 2). The interior of the smoke detection chamber preferably has a flat or dull black finish. The lower half 21 has a smoke inlet 23 (FIGS. 1 and 2) and a smoke outlet 26. Barriers or partitions 24 are positioned adjacent the inlet 23 and the outlet 26 and extend above the surface of the lower half 21 (FIG. 2) and into chambers 25 formed by the upper half of the chamber 21' (FIG. 3). Smoke entering into the interior of the smoke detection chamber is forced to follow a serpentine path up over each of the barriers 24 positioned in the chambers 25 as indicated by the arrows in FIG. 1.

The two halves, 21 and 21' of the smoke detection chamber together form light passage 27 which permits light from the light source 16 to illuminate the interior 22 of the smoke detection chamber, light passage 28 positioned relative to passage 27 so as to permit light emitting from illuminated passage 27 to fall on light sensitive resistor LDR-2, and light passage 29 which is positioned relative to passage 27 (and preferably parallel to passage 28 as shown) so as to permit only light reflected by smoke present in the interior 22 of the smoke detection chamber to fall on light sensitive resistor LDR-1.

The relative positioning of passages 27 and 29 is important for detecting white and gray smoke as well as black smoke. It has been found that in order to have this capability, the angle alpha formed by projecting the longitudinal center axis lines of the passages 27 and 29 must be greater than 90° and preferably at least 120° but not more than 150° (see the dotted lines in FIG. 1).

It is also preferred to have the opening 29'of the passage 29 face away from passage 27. Preferably the opening 29' forms an angle beta with its longitudinal axis as shown in FIG. 1 which is also greater than 90° preferably from 145° to 175°. The angle beta is also preferably chosen such that a projection of the plane of the opening 29' intersect the longitudinal center axis of the passage 27 but fails to intersect passage 27 itself (again see the dotted lines in FIG. 1).

The two halves, 21 and 21' of the smoke detection chamber also cooperate to form slots 30 at both the inlet and outlet of the chamber for purposes of containing an inserted screen 31 (FIG. 2) which prevents unwanted large particles and insects from entering and clogging the labyrinths formed by barriers 24 and chambers 25.

A 120-volt, 10-watt long-life, double contact bayonet socket lamp is preferably used as the light source 16. This source furnishes the illumination required for smoke detection and also serves as the pilot or monitor light. Light enters the smoke chamber 20 from lamp 16 through tubular passage 27 and illuminates the internal space 22 which can be penetrated by smoke via the two labyrinths formed by barriers 24 and chambers 25 (described previously) which also prevent unwanted outside stray light from entering the interior 22 of the chamber 20.

Figure 4:
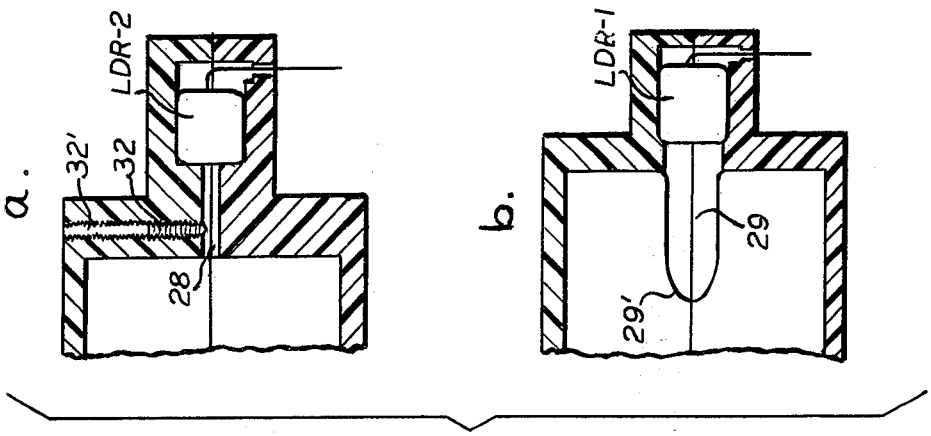
FIG. 4*a* is a partial sectional view taken along line 4*a*—4*a* of FIG. 3.
FIG. 4*b* is a partial sectional view taken along line 4*b*—4*b* of FIG. 3.

Direct light reflected from the walls of the tubular passage 27 (which can be threaded or similarly grooved to limit the scope of emerging light) reaches light sensitive resistor LDR-2 by way of a small cylindrical passage 28 which is appropriately aimed. As set screw 32 (FIG. 4*a* ) entering at a right angle into passage 28 can be used to partially obstruct this passage such that the amount of light falling on LDR-2 may be adjusted for purposes of calibrating the smoke detector of the invention.

Light sensitive resistor LDR-1 is shaded by having the opening 29' of passage 29 face away from passage 27 as described previously. In this way LDR-1 is shaded from direct and first order reflected light which enters internal space from light source 16. When smoke is present inside chamber 20, i.e., in internal space 22, that smoke is illuminated by lamp 16 and a portion of this illumination is reflected by the suspended particles of the smoke and is thus made to fall onto LDR-1 via passage 29, causing a reduction in resistance and a subsequent alarm condition.

In the absence of light, caused by the failure of lamp 16, light fails to reach LDR-2 and the resistance of this light sensitive resistor increases and subsequently causes a trouble signal.

The light is normally made to fall on LDR-2 determines the value of smoke intensity at which LDR-1 will cause an alarm condition.

The smoke detector of the present invention has three modes of operation, a standby mode, a trouble mode and an alarm mode. The standby mode exists when the smoke detector is connected to a source of current, the lamp 16 is operating in its normal fashion and no smoke is present in the interior space 22 of the chamber 20, nor is there any obstruction which would prevent light from falling on LDR-2. The trouble mode exists when the smoke detector is energized, but light fails to reach light sensor LDR-2. The trouble signal consists of an intermittent sound which is produced by the horn 14. The alarm mode is brought about by the presence of smoke in the internal space 22 of chamber 20 and the subsequent illumination by reflected light of sensor LDR-1. The alarm signal consists of a continuous emission of sound from the smoke detector horn 14.

Figure 5:
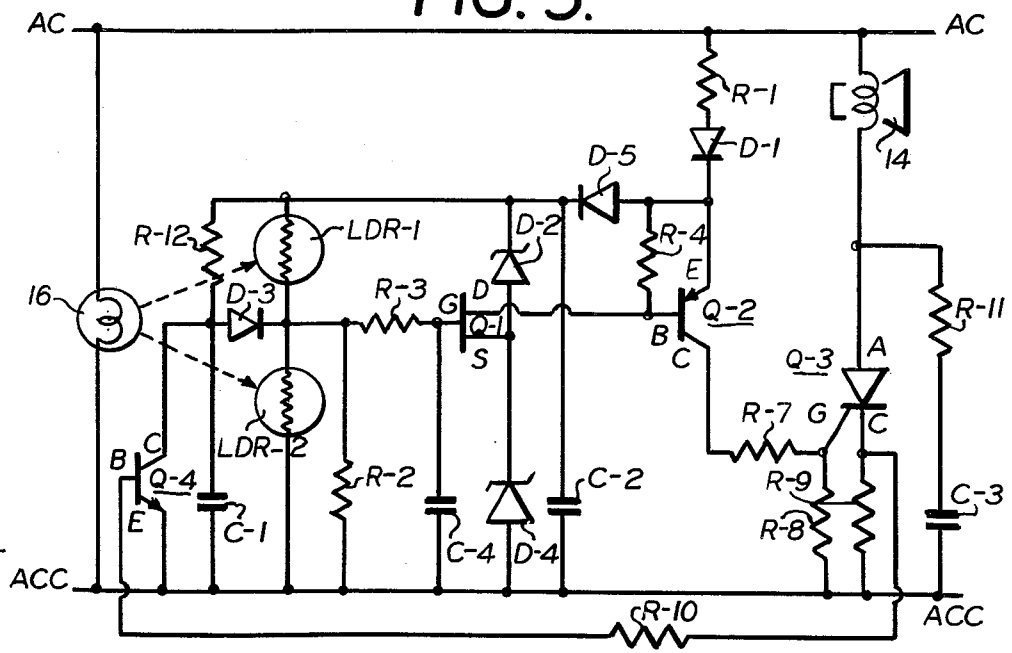
FIG. 5 is a circuit diagram illustrating the functions and relationships between the electronic components of the smoke detector and alarm of the invention.

The functions of the electronic components of the circuit utilized for the three modes of operation described above will now be described with reference to FIG. 5 of the drawing.

Resistor R-1 is the route by which energy from the power source reaches the working parts of the detector. It serves to provide current through diodes D-1 and D-5 to storage capacitor C-2, the voltage of which is regulated by the simultaneous action of Zener diodes D-2 and D-4.

Diode D-1 serves to make the equipment operational during that half-cycle of the power line when the silicon control rectifier (SCR) Q-3 could be energized.

Diode D-5 serves to isolate the direct current portion of the circuitry, which is to the left of diode D-5, from the half-wave alternating current portion of the circuit, which is to the right of diode D-5. The presence of diode D-5 prevents storage capacitor C-2 from being significantly discharged when the unit is in the alarm mode.

The voltage which is developed across Zener diode D-4 is about one-half the value of voltage existing across both diodes D-2 and D-4. That lesser voltage serves as a reference to detector Field Effect Transistor (FET) Q-1. This reference potential is connected to the source S of that transistor. The other sensing pole of this detector is its gate G.

The voltage which is developed across storage capacitor C-2 is also applied to the series connection of resistors LDR-1 and LDR-2. These two resistors from a voltage divider. The magnitude of the voltage at their junction depends on the values of these two resistors which in turn depends on the levels of illumination which fall on their surfaces. When smoke is present; resistor LDR-1 has a higher level of illumination and as a result its resistance drops. Reduction in the value of the resistance of LDR-1 causes an increase in the voltage at the junction of LDR-1 and LDR-2. This increase in voltage is communicated by way of resistor R-3 and capacitor C-4 which collectively serve as a lowpass filter to the gate G of the transistor Q-1. When the voltage at the gate approaches the reference voltage at the source S of Q-1, Q-1 starts to conduct. This conduction is directly communicated to the base B of silicon PNP transistor Q-2 which by this action is also made to conduct. The conduction of Q-2 causes a pulsing current to flow through Q-2 by way of R-1 and D-1, and this pulsing current is communicated by way of current limiting resistor R-7 to the gate G of Silicon Rectifier Q-3. Current pulses into the gate of Q-3 causes Q-3 to turn on (conduct) during each line cycle and causes current to flow through horn 14 and resistor R-9. The presence of this current through horn 14 causes the emission of a continuous alarm sound.

Resistor R-11 and capacitor C-3 are a dual function network which prevents line transients from prematurely triggering Silicon Control Rectifier Q-3 and which insure a current through Q-3 following the termination of the trigger pulse and before the current through horn 14 has risen to a value beyond the holding current of the Silicon Control Rectifier Q-3.

Resistor R-8 serves to provide the gate of the Silicon Control Rectifier Q-3 with a low impedance as is required to prevent line voltage transients induced false triggering.

Resistor R-4, which is associated with Q-2, serves to provide a leakage path for collector to base leakage current and as such makes it possible for the smoke detector to operate flawlessly at elevated tempertures. Also, R-4 reduces the trigger sensitivity of the circuit to the desired design value.

Resistor R-9 which is associated with a cathode C of Q-3 serves to sense the current through Q-3 and is functionally associated with the trouble circuit. Similarly, R-10, R-12, D-3, C-1 and Q-4 are also specifically associated with and collectively constitute the trouble circuit.

The trouble signal is initiated by the absence of light on LDR-2. Without light on LDR-2 the resistance of LDR-2 increases toward infinity. A small continuous current is made to flow into LDR-2 by way of resistor R-12 and diode D-3. When the value of LDR-2 is low, this current has a small effect in causing a voltage to exist across both LDR-2 and C-1. However, as LDR-2 increases in resistance the voltage across C-1, and across LDR-2, increases until such time as to be of trigger magnitude as determined by trigger transistor Q-1. Once Q-1 triggers, Q-2 conducts, as does Q-3. This causes current to flow through horn 14 as well as R-9. The current through horn 14 causes a sound. The current through R-9 causes the development of a voltage across R-9, and a current to flow through R-10 into the base of quench transistor Q-4. The current into the base of Q-4 causes Q-4 to conduct sharply. This conduction discharges capacitor C-1. With the C-1 voltage thus reduced trigger conditions no longer exist, and the sound is terminated. However, current continues to flow through R-12 causing C-1 to charge up again until Q-1, Q-2, Q-3 can again trigger and conduct. This cycle is repeated and results in an intermittent emission of sound from the horn 14. The repetition rate of this action is substantially determined by the choice of R-12 and C-1.

Diode D-3 effectively de-couples the trouble circuitry from the alarm circuitry. C-1 is discharged whenever Q-3 fires, be this due to a trouble condition or due to an alarm condition. However, if triggering is caused by a reduction in resistance of LDR-1, then the voltage at the gate of Q-1 is determined essentially by the ratio of the resistances of LDR-1 and LDR-2, and the discharge of C-1 which determines the voltage at the junction of R-12 and C-1 is ineffective in preventing the continuous emission of the alarm sound.

Resistor R-2 associated with LDR-2 serves to limit the voltage which can exist at the junction of LDR-1 and LDR-2.

Both LDR-1 and LDR-2 are affected by the same light source 16. The brightness of 16 is affected by aging or dirt and is greatly affected by the value of the alternating current line voltage which is applied to the smoke detector. Thus, the line voltage indirectly also greatly, and in equal ratio, affects the values of resistance of LDR-1 and LDR-2. Triggering is caused when LDR-1 has a certain ratio to LDR-2. Their absolute values, within limits, are unimportant. Under the influence of illumination changes, both LDR-1 and LDR-2 change by the same factor but their ratio, which determines the trigger point, is unaffected. The operation of the smoke detector is thus substantially unaffected by alternating current line voltage variations, and by darkening due to aging or the deposition of dirt and dust with time.

The smoke detector of the invention will tolerate the presence of dust in the smoke chamber and in fact becomes more sensitive under such a condition. Prior art detectors have been found to undesirably decrease in sensitivity with dust build up.

It has also been found that the smoke detector of the invention will not malfunction if a gross reduction in line voltage occurs as has been experienced with prior detectors. Instead the detector goes into a modified trouble mode when a condition of gross reduced voltage occurs emitting a ticking sound and when the normal voltage is restored, the unit automatically returns to the stand by mode.

What is claimed is:

1. Smoke detector and alarm comprising a. smoke chamber means;

b. circuit means connecting a light source, a first light sensitive resistor, a second light sensitive resistor and electronic alarm means;

c. the smoke chamber means having i. a first light passage permitting light from the light source to illuminate the interior of said chamber;

ii. a second light passage positioned relative to said first passage so as to permit light from said first passage to fall on said second light sensitive resistor;

iii. a third light passage positioned relative to said first passage so as to permit only light reflected by smoke present in said chamber to fall on said first light sensitive resistor said third light passage being parallel to said second light passage; and iv. said first, second and third light passages providing unobstructed, direct communication for said light source and said light sensitive resistors with the interior of said smoke chamber;

d. said circuit means having:

i. alarm circuit means causing said alarm means to emit a continuous sound when light from said source is reflected by smoke present in said chamber onto said first light sensitive resistor; and ii. trouble circuit means causing said alarm means to emit an intermittent sound when light fails to fall on said second light sensitive resistor.

2. Smoke detector of claim 1 wherein the longitudinal axis of said third light passage forms an angle greater than 90° with the longitudinal axis of said first light passage.

3. Smoke detector of claim 1 wherein the third light passage opens into the smoke chamber in such a way that it faces away from the first light passage and forms an angle greater than 90° with the longitudinal axis of the third light passage.

4. Smoke detector of claim 3 wherein said angle is at least 120° but not more than 150°.

5. Smoke detector of claim 1 wherein said circuit means includes means to prevent line voltage variations from inducing false triggering of said alarm means.

6. Smoke detector of claim 1 wherein said circuit means includes means to maintain the ratio of the resistances between said light sensitive resistors constant so as to be unaffected by changes in brightness of said light source.

7. Smoke detector of claim 1 wherein said second light passage is provided with calibration means to adjust the amount of light falling on said second light sensitive resistor.

* * * * *